United States Patent [19]

Pedersen

[11] Patent Number: 4,610,413

[45] Date of Patent: Sep. 9, 1986

[54] PEGBAR DISPLAY DEVICE

[75] Inventor: Gerald D. Pedersen, Stanton Township, Goodhue County, Minn.

[73] Assignee: Cannon Equipment Company, Cannon Falls, Minn.

[21] Appl. No.: 514,070

[22] Filed: Jul. 15, 1983

[51] Int. Cl.[4] ..... E04G 3/00

[52] U.S. Cl. ..... 248/220.3; 211/59.1; 248/220.4; 248/222.3

[58] Field of Search ..... 248/220.3, 220.4, 221.1, 248/221.2, 222.2, 222.3, 231.9, 245; 211/59.1, 57.1; 403/247

[56] References Cited

U.S. PATENT DOCUMENTS

| | | | |
|---|---|---|---|
| 3,486,632 | 12/1969 | Balch | 248/221.2 |
| 3,495,717 | 2/1970 | Lavin et al. | 248/220.3 |
| 3,567,036 | 3/1971 | Tonjum et al. | 248/220.3 |
| 3,837,754 | 9/1974 | Malcik | 403/247 |
| 3,986,613 | 10/1976 | Mayer | 211/57.1 |

FOREIGN PATENT DOCUMENTS

| | | | |
|---|---|---|---|
| 82/0321 | 10/1982 | PCT Int'l Appl. | 211/59.1 |
| 1483450 | 8/1977 | United Kingdom | 248/220.4 |

*Primary Examiner*—Ramon O. Ramirez

*Attorney, Agent, or Firm*—Henry C. Kovar

[57] ABSTRACT

A pegbar display device for presenting packages such as cold cut or cheese packages for retailing has an improved peg support bar and an improved peg; the bar is a rectangular tube having a greater height than depth, the bar front member has a keyhole that is taller than it is wide and with a flat bottom, the bar back member has a corresponding backbore which is directly behind and slightly below the keyhole; the peg has a front body, a toe on the back of the body, a horizontal indexing flat on the bottom of the peg, and lateral abutments between the toe and the index flat; the peg is turned ninety degrees to go into the bar; when in the bar the peg is then turned back ninety degrees and the index flat rests upon the keyhole flat bottom and the abutments engage the inside of the tubular bar to retain the peg in the bar, the peg bar is of lesser weight and very strong, and does not droop when loaded.

13 Claims, 10 Drawing Figures

PEGBAR DISPLAY DEVICE

BACKGROUND OF THE INVENTION

1. Field of the Invention

This invention pertains to a display device of the type called a pegbar; the device is commonly used for display of packages of meat and cheese in supermarket coolers, and for presentation of blister packaged small goods such as tools, auto parts and pet supplies.

2. The Prior Art

Display devices of this type are commonly termed peg bars. Peg bars are most often used and seen in businesses that retail groceries, specifically super markets, grocery stores and convenience stores. Peg bars are being used to display pre-packaged cheese slices and sliced sandwich meat. Peg bars are also used for blister packaged goods such as small auto parts, electronic goods, cabinet hardware, screws and nails, and the like.

The typical pegbar has a transverse structural bar fastened to a wall of some type. The structural bar serves as a beam for pegs which are supported in any one or more of a series of holes and slots along the length of the bar. The bar is loaded under both beam and torsional stress.

One well known existing pegbar is used by Kraft Foods. This display device has an angle iron which is disposed with its apex down or in the V configuration. The front flange of the V-shape has vertical slots cut in through the top edge. The back flange of the V-shaped bar has an obround hole behind each of the front flange slots. The pegbar is a length of round steel wire having an upturned nose and a pair of spaced apart vertical flags on the back of the flag. The "flag" referred to is a flattened length of wire that has been hit in flat dies on each side and the wire is changed from round to flat. In the just described pegbar, the back flag goes into the back flange hole and the front flange goes into the slot. The peg is then indexed with the flags being upright and the peg nose being upright, and the peg is retained in the bar by a round section in between the flags. The round section cannot be pulled through the front slot nor pushed through the back hole.

This pegbar does have its disadvantages. Firstly, it's heavy and material intensive. For example, a standard fourty-eight inch long bar with eleven pegs weighs 10 lbs. 5 ozs. At this weight the bar is made of the standardly used $3/16 \times 1\frac{1}{2} \times 1\frac{1}{2}$ angle iron which is the standard bar material. The pegbar tends to droop from both torsional and beam loading. For example, a full load of meat or cheese on this bar will droop the noses of the centrally located pegs well in excess of two inches as measured vertically. The V-bar simply does not have enough strength either in bending or torsion to support a full load of goods on its pegs.

Close vertical spacing of pegbars one above the other is important to retailers. By getting the pegbars as close as possible, more horizontal rows of goods can be displayed in a given length of floor space, shelf space, or cooler space. Conversely, a shorter cooler may be used with more efficient pegbars. The sag of known pegbars, such as just described, means the pegbars have to be spaced package height plus clearance and allowance for sag of the middle pegs and a row may be lost.

An important criterion for pegbars is that the peg be removable, together with unsold packages left on the peg, and the peg be refillable or reloadable from the back so that inventory can be sold on a FIFO basis without loss of product that was previously unsold. This is critical in the retailing of perishables. In order to be loadable from the back, the peg must have a minimal cross section so that the pierced hole in the packages is not ripped out. The large vertical flags on the just discussed peg do tend to vertically tear the package holes, and then the package must be discounted or discarded. Another of the detrimental aspects of the prior pegbar is that the nose of the peg must be lifted almost three inches to remove the peg for reloading and for reinstallation of the loaded peg. Consequently, the pegbars had to be mounted above one another a height equal to package height plus about three inches. For some reason the pegs in this type of bar tend to bend at the edge of the flags, probably from excessive stress concentration. The V-section is also a trap for dust, product and debris.

Another type of pegbar is used by Oscar Mayer. This pegbar utilizes what is more or less the same bar as the Kraft bar, but the Mayer bar has a flat in what was the obround hole in the rear flange. The peg is round and has an upturned nose but does not have rear flags. This peg has a machined or headed horizontal notch in the top of the back of the.peg. The notch faces upward and engages the top flat in the back hole to index the peg and to retain the peg in the bar. This peg is easy to remove and install; it only has to be turned about sixty degrees and it will then either come out or go in. The problem with this peg is that it does not stay in well and it falls out too often, especially when customers pull upward on packages they are removing from the peg. Again, this pegbar is relatively heavy and a standard forty-eight bar with eleven pegs weighs about ten and one half pounds. The peg is also difficult to engage and index properly because it is very easy to push in too far or not enough.

OBJECTS OF THE INVENTION

It is an object of the present invention to provide an improved pegbar having a high beam and torsional strength together with reduced material requirements.

It is an object of the present invention to provide a new pegbar in which the peg is easily removable yet positively retained in the bar.

It is an object of the present invention to provide an improved pegbar having a positive locking peg that needs a minimum of vertical displacement for removal or installation.

It is an object of the present invention to provide a pegbar having a positive locking peg that can be easily loaded from the rear for FIFO retailing.

It is an object of the present invention to provide a pegbar kit that can be advantageously packaged.

It is an object of the present invention to provide an improved peg for a pegbar, the improved peg being positively lockable and easily removable from a bar.

It is an object of the present invention to provide an improved bar for a pegbar, the bar having substantial strength with minimal material and positive locking and index features for receiving an improved peg.

SUMMARY OF THE INVENTION

According to the principles of the present invention, a pegbar for presenting goods has a peg support with a front keyhole and a backbore for accepting a peg; a peg having a body, a rear toe, a bottom flat engageable with the keyhole for indexing the peg; and a lateral abutment for engaging the inside of the support for positively retaining the peg in the support.

A peg for a pegbar has a front body for support of goods, a toe forming the back end of the peg, a horizontal index device between the body and toe, and a lateral abutment in between the body and toe for engaging a peg support and retaining the peg in the support in a properly indexed position.

A peg support for a pegbar has a front member, a rear member, a keyhole in the front member for accepting and supporting a peg, a backbore in the rear member for accepting a peg toe, and an index structure in one of the keyhole or the backbore for radially indexing the peg.

AS SHOWN ON THE DRAWINGS

Figure 1:
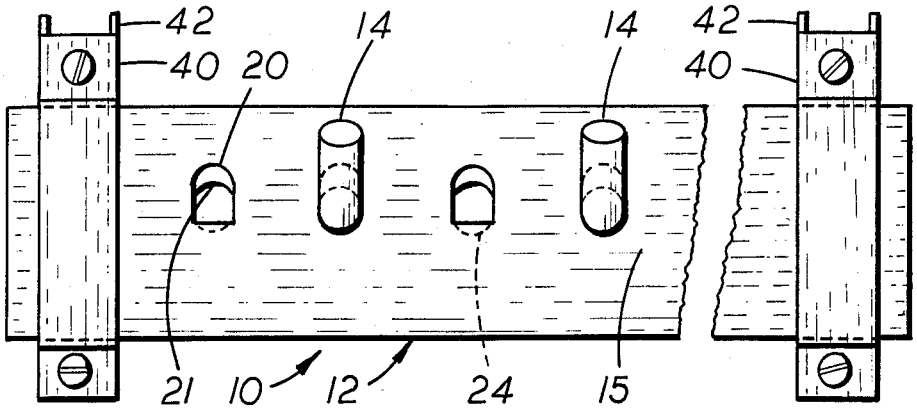
FIG. 1 is a front elevational view of the preferred embodiment of a pegbar display device according to the present invention.
Figure 2:
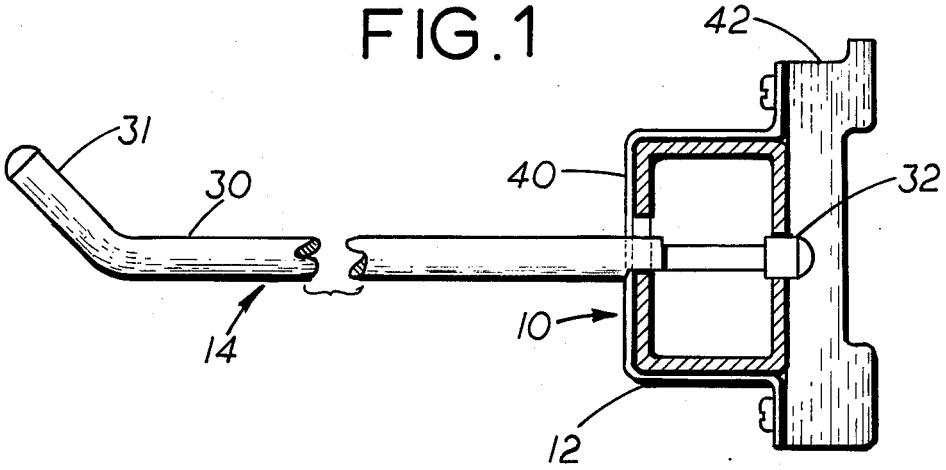
FIG. 2 is an elevational end view of the device of FIG. 1.
Figure 3:
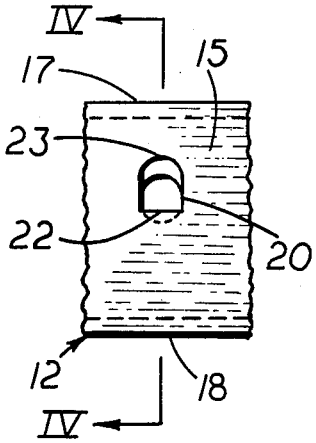
FIG. 3 is an elevational front view of a front keyhole in the bar.
Figure 4:
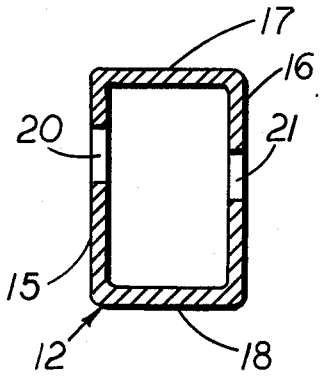
FIG. 4 is an elevational side sectional view taken through lines IV—IV of FIG. 3.
Figure 5:
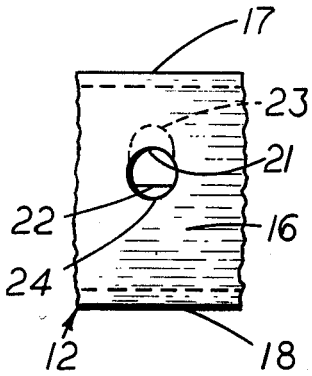
FIG. 5 is an elevational rear view of the bar, showing a backbore.
Figure 7:
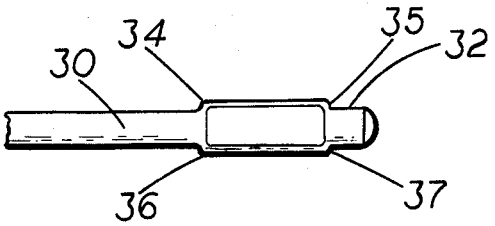
FIG. 7 is a top plan view of the back of the pegbar of FIG. 6.
Figure 6:
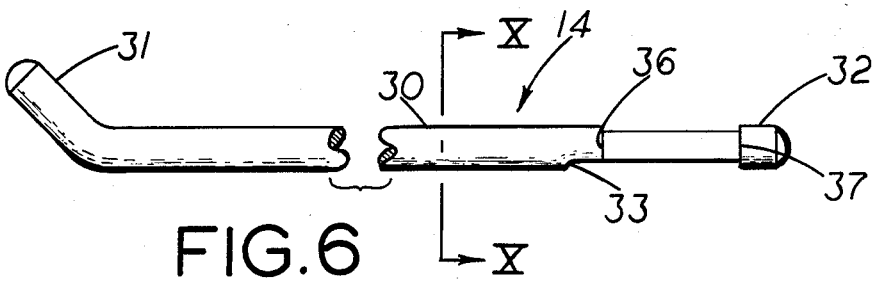
FIG. 6 is an elevational side view of the preferred embodiment of a peg as in and for the device of FIG. 1.
Figure 8:
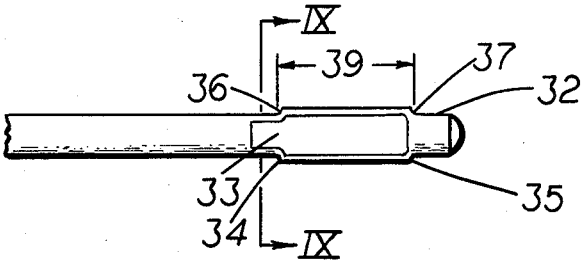
FIG. 8 is an upward looking plan view of the bottom of the back of the pegbar of FIG. 6.

The principles of the present invention are particularly useful when embodied in the pegbar display device shown in FIGS. 1 and 2 and generally indicated by the numeral 10. The pegbar 10 includes an improved peg support or bar 12 and one or more improved pegs 14 for presentation and display of goods.

The bar 12 is an elongate length of closed tubing, preferably of thin wall rectangular tubing. The bar 12 has a front member 15, and a rear member 16 which is spaced from the front member 15 by a top 17 and a bottom 18. The bar 12 is used in a position wherein the front and back members 15, 16 are both taller than the top and bottom 17, 18 are deep. A preferred tube for the bar 12 is low carbon welded rectangular tubing of one inch by one and one-half inches on the outside with one-sixteenth inch wall thickness. The bar 12 has its height substantially greater than its depth so that the bar has optimal beam and torsion strength. The top 17 and bottom 18 are both imperforate for strength, appearance and cleaning, and the front and rear members 15, 16 have the structure for supporting the pegs 14.

The structure for supporting the pegs 14 comprises one or more keyholes 20 in the front member 15, and behind each keyhole 20 is a backbore 21 in the rear member 16. All of the keyholes 20 are alike and all of the backbores 21 are alike. A respective pair of keyholes 20 and backbore 21 holds one peg 14. The respective pairs of keyholes 20 and backbores 21 are evenly spaced along the transverse length of the bar 12 and a peg 14 will fit in any pair. The transverse spacings between adjacent pegs 14 can be varied to optimally space the pegs 14 for the package to be presented.

Each keyhole 20 is vertically located slightly above a center or mid-level of the bar 12 as measured between the top and bottom 17, 18. Each keyhole 20 has a flat bottom 22 which extends the full width of the keyhole 20. At the top of the keyhole 20 is a rounded top 23 having a diameter equal to the width of the keyhole flat bottom 22. The height of the keyhole 20 is greater than the width of the keyhole 20. A specific preferred size of keyhole 20 is 0.297 inches wide by 0.350 high.

The backbore 21 is directly behind and slightly lower than a respective keyhole 20. Each backbore 21 is centered on the vertical centerline or mid-level of the back member 16 and each keyhole 20 is slightly higher than a respective backbore 21. A specific preferred size of backbore is 0.318 inches diameter. The keyhole flat bottom 22 is at a level above the level of a bottom 24 of the backbore 21.

Figure 10:
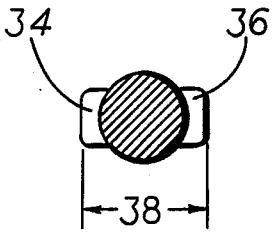
FIG. 10 is an elevational view in section, taken through lines X—X of FIG. 6.
Figure 9:
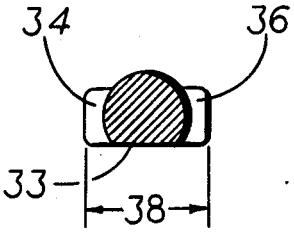
FIG. 9 is an elevational view in section, taken through lines IX—IX of FIG. 8.

The pegs 14 are all substantially identical and interchangeable. The standard length for the peg 14 is twelve inches. Each peg 14 has a body 30 on the front part of the peg 14 for support of goods for presentation during retailing. On the very forward end of the body 30 is an upwardly turned nose 31 that lies in a vertical plane, as seen from the front as in FIG. 1. Each peg 14 has a toe 32 forming the back end of the peg 14. The toe 32 and body 30 are of the same diameter; a preferred diameter is 0.283 inch. Between the toe 32 and the body 30 is a horizontal indexing flat 33. The indexing flat 33 is cold headed into the peg 14 while a round section above the flat 33 is restrained in its original round form and diameter. That part of the peg 14 which is immediately above the flat 33 has a round cross section, save for the flat 33 as is best seen in FIG. 9. The index flat 33 has a width which is equal to a majority of the width of the peg body 30. For example, if the peg body 30 is of the preferred 0.283 inch diameter, the index flat 33 has a width greater than 0.142 inch. Behind the index flat 33 and between the body 30 and the toe 32, is a first lateral abutment 34 which extends rearward to a first rear abutment 35. The first abutments 34, 35 are co-planar with each other and the rear abutment 35 is a rearward facing extension of the first lateral abutment 34. On the opposite side of the peg 14 is a second lateral abutment 36 and a second rear abutment 37. The second rear abutment 37 is a rearward facing extension of the second lateral abutment 36. Both rear abutments 35, 37 are just forward of the toe 32. The horizontal index flat 33 lies in a horizontal plane which is perpendicular to the vertical plane of the nose 31, as best seen in FIGS. 1 and 9. The abutments 34, 35, 36, 37 all lie in a common thick horizontal plane just above plane of the index flat 33. The abutments 34, 35, 36, 37 have a width 38 as best seen in FIG. 10 which is less than one and one-half times the diameter of the body 30 and toe 32, and which is less than the height of the keyhole 20. The abutment width 38 is greater than the width of the keyhole 20 and the diameter of the backbore 21. A preferred abutment width 38 is 0.333 inches. Both the first and second lateral abutments 34, 36 face forward and are at the same place along the length of the peg 14 just rearward of the index flat 33. The rear abutments 35, 37 face rearward at the same place on the length of the peg 14 and just forward of the toe 32. The length 39 between the front abutments 34, 36 and the rear abutments 35, 37 is less than the spacing between the keyhole 20 and the backbore 21.

The bar 12 is clamped by a pair of support clamps 40 to a pair of mounting brackets 42. The brackets 42 are intended to hook into vertical shelf holders (not shown) and the clamps 40 enable loosening and sliding of the brackets on the bar 12 to match the spacing between the shelf holders. Each clamp 40 and bracket 42 has a width less than an internal cross section width of the tubular bar 12 and a height less than the internal height of the tubular bar 12, so that all of the clamps 40 and brackets 42 fit within the tubular bar 12. When the pegbar 10 is packaged, a plurality of pegs 14 and the clamps 40 and brackets 42 are all placed inside of the tubular bar 12 and the pegbar 10 is then shipped while occupying the minimum volume possible. When the pegbar user receives the packaged pegbar 10, all of the pegs 14, clamps 40 and brackets 42 are easily emptied out of the bar 12.

In use and operation of the pegbar 10, the bar 12 is mounted to some type of upright backboard or frame (not shown). The pegs 14 are inserted in the bar 12 by turning the peg 14 ninety degrees so the abutments 34, 35, 36, 37 will go through the keyhole. When the peg 14 is inserted, the toe 32 will go into the backbore 21 and the rear abutments 35, 37 will abut against the back member 16 and stop insertion of the peg 14. The peg 14 is then turned ninety degrees so the nose 31 points upward. The index flat 33 will positively engage the keyhole flat bottom 22 and radially index the peg 14 to the bar 12. The front lateral abutments engage the inside of the bar front member 15 on each back side of the keyhole 20 and prevent the peg 14 from being pulled out of the bar 12. The peg 14 is held substantially horizontal when the peg 14 is indexed in the keyhole 20 and the backbore 21. The more weight that is hung on the peg body 30, the more positive is the engagement of the index flat 33 upon the keyhole flat bottom 22. The peg 14 can be loaded from the front while in the bar 12, if FIFO is not important. If FIFO is important, for perishable goods, the peg 14 can easily be loaded from the back. Assuming there are unsold goods such as cold cuts or cheese on a peg 14, the peg 14 is removed from the bar 12 by turning the peg ninety degrees and lifting the nose 31 upward about ¾ inch. The peg 14 with the goods on it then comes out and off of the bar 12. New packages are then pushed over the peg abutments 34–37 and onto the peg body 30. The abutments 34–37 have a width 38 less than the aperture of the packages so there is no tearing of packages. The loaded peg 14 is then reinstalled as previously described. The index of the peg 14 to the bar 12 is absolutely solid with no rocking of the peg 14. The more the peg 14 is loaded, the more pressure on the index. The physical contact of the index flat 33 on the keyhole flat bottom 22 actually supports the load on the peg 14. If and when the peg 14 is pulled up by a customer removing a package, the peg 14 will not accidentally pull out of the bar 12. These pegs 14 have tested stronger than the previous pegs and the bar 12 has exceptionally high torsional and beam stiffness; the pegs 14 do not drop with this new pegbar 10. This new pegbar 10 also offers significant advantages because it uses less material and weighs less for shipping. As a specific example, a forty-eight inch bar 12 and eleven pegs 14 ready to ship weighs only 7 lbs. 1 oz., versus 10 lbs. 5 ozs. for the prior successful pegbars. This new pegbar 10 is also shallower than the predecessors. This new bar 12 has only a one inch forward projection versus a two and one-eighth inch projection for the previous bars. This enables pegs 14 of one inch longer to be used in a given total depth for the pegbar 10. The pegbars 10 can be closer together one atop of another, because these pegbars 10 do not droop and because of the minimal height needed to lift up and remove or replace the pegs 14 with or without goods on the peg body 30. The pegs 14 are not accidentally pulled out of the bar 12. The pegs 14 do not rattle from side to side, because of the positive index. The bar 12 does not have a visible debris trap and does not have sharp edges. The bar 12 and the pegs 14 can all be easily cleaned without danger of damaging fingers. It is impossible to get a finger caught and squashed in this new pegbar 10. When these new pegbars 10 are used by the retailers and public, many more advantages will probably be found.

Although other advantages may be found and realized, and various and minor modifications suggested by those versed in the art, be it understood that I wish to embody within the scope of the patent warranted hereon, all such embodiments as reasonably and properly come within the scope of my contribution to the art.

I claim as my invention:

1. A pegbar for presenting goods, said pegbar comprising:

(a) a peg support having a front keyhole with a nonmovable and fixed full width upward facing flat bottom and a fixed back bore, said keyhole and said back bore being aligned with each other with the keyhole being spaced forward of the back bore, for rotatably accepting therein a peg toe inserted firstly through the keyhole and then into the back bore, said keyhole having a height greater than its width;

(b) a round wire peg easily insertable in and removable from the keyhole and the back bore of the support, said peg being relatively rotatable in the keyhole and back bore and having (1) a forward extending body for support thereon of goods to be presented by the pegbar, (2) a round distal toe forming the back end of the peg, (3) a bottom indexing flat spaced forward of and discrete from the toe and facing downward on the peg, said flat having a width at least equal to a majority of the width of the peg body and the keyhole bottom, said index flat being engagable directly against the keyhole bottom for and so that the peg is rotatably indexed and fixed with respect to the support by the weight of the body and the weight of any goods on the body forcing the indexing flat downward and onto and against the keyhole bottom.

(4) a forward facing lateral abutment forward of the toe and extending transversely from the peg body and parallel to and above and immediately rearward of the indexing flat for abuttingly engaging the support immediately to the rear and to the side of the keyhole only when the flat is parallel to the bottom, the width across the peg at the abutment being less than said keyhole height and greater than said keyhole width and greater than either the width or the height of the back bore, so that the abutment can not be pushed completely through or withdrawn from the support when the indexing flat is on the keyhole flat bottom; and (c) in which said abutment normally retains the peg in the support by said abutting engagement, said peg and said abutment being rotatable about 90 degrees in the peg support like a key, for easy and selective withdrawal or insertion of the peg from or into the keyhole and back bore of the support and for locking and unlocking the peg into and from the support without requiring excessive lifting of the peg body.

2. A pegbar according to claim 1, in which the peg support is a rectangular section tube having an imperforate top and bottom and a height substantially greater than the depth of the tube, the back bore being generally at a mid level of a back wall of the tube and the keyhole being generally at a similar level in a front wall of the tube.

3. A pegbar according to claim 2, including support clamps and mounting brackets, said clamp and brackets each having a width less than an internal cross section of the tube, said clamps and brackets being packagable inside of said tube together with a plurality of said pegs, for shipping of the complete pegbar in kit form with all of the clamps, brackets, and pegs inside of the tube.

4. A pegbar according to claim 1, including a pair of said forward facing lateral abutments, said abutments being equadistantly spaced from said round toe and being opposed to each other on opposite sides of the peg and having a width across themselves which is greater than a width of the keyhole or a diameter of the peg, and less than one and one-half times a diameter of the peg body and less than a height of the keyhole, each of said abutments projecting transversely beyond the diameter of the peg so that they both abut against the support, one on each side of the keyhole.

5. A pegbar according to claim 4, including a pair of similar transverse rearward facing abutments on the peg equadistantly spaced just forward of the toe and rearward of the forward abutments for engaging the peg support in front of and to the sides of the back bore, said rearward abutments having a transverse width there across which is less than the height of the keyhole and greater than a height or width of the back bore and less than one and one-half times the diameter of the peg body and greater than the diameter of the peg.

6. A pegbar according to claim 1, in which the peg has a round cross section above the indexing flat, said round section extending diametrically around more than half of the peg.

7. A round wire peg for a pegbar display device, comprising:

(a) a body for support of goods to be presented, said body being the front of the peg, (b) a distal round toe forming the back end of the peg;

(c) a horizontal downward facing index flat on the bottom of the peg and between the body and the toe, said index flat being spaced forward of and being discrete from the toe for vertically engaging an upward facing front peg support indexing bottom for supporting the body and for radially indexing and fixing the peg with respect to the peg support, said flat having a width equal to a majority of the width of the peg, and (d) a pair of diametrically opposed and co-planar and generally horizontal abutments in between the index flat and the toe and extending transversely from the body for engaging the peg support on each side of the indexing bottom for locking and retaining the peg in the support when the peg is radially indexed to the support, said abutment being rearward of and immediately adjacent to said horizontal index flat, the width of the lateral abutments as measured across the peg being less than one and one-half times the diameter of the peg and being more than the diameter of the peg, each said abutment projecting transversely beyond the diameter of the peg and being equidistantly spaced forward of the toe.

8. A peg according to claim 7, including a second such abutment for engaging the peg support for retaining the peg in the support when the peg is indexed to the support, said second lateral abutment being on an opposite side of the peg from the first lateral abutment and being coplanar in a common horizontal plane with the first lateral abutment, the width of the lateral abutments as measured across the peg being less than one and one-half times the diameter of the peg.

9. A peg according to claim 7, in which that part of the peg which is immediately above the horizontal flat, has a round cross section save for the flat.

10. A peg according to claim 9, in which the horizontal flat is cold headed while the round section above the flat is restrained in an originally round shape.

11. A peg according to claim 8, in which the width of the lateral abutment measured across the pegs, is less than one and one-half times the diameter of the body.

12. A peg support for a pegbar comprising;

(a) an elongate rectangular closed cross-section tube having an imperforate top and bottom, a front member and rear member spaced from each other by the top and bottom with a spacing between the top and bottom being greater than the spacing between the front and rear members;

(b) a non-circular keyhole completely within and through and completely bounded by the front member for accepting and for supporting a peg, said keyhole having a height greater than its width;

(c) a back bore in and through the rear member for accepting a peg toe, said back bore having an identical width and height, (d) an upward facing fixed and rigid flat bottom in the keyhole for radially indexing and fixing the peg with respect to the support; said flat bottom being the full width of the keyhole; and (e) in which the keyhole and back bore are in between and are spaced from both of the top and the bottom, so that a peg having an abutment may be turned about 90 degrees and inserted through the non-circular keyhole and into the back bore with the abutment also being inserted through the keyhole, and then turned about 90 degrees while in the keyhole and the back bore and while between the top and bottom for locking the peg into the support and for subsequently turning of the peg about 90 degrees for unlocking the peg for subsequent removal of the peg from the support.

13. A peg support according to claim 12, in which the radial indexing means is a flat bottom in the keyhole, said flat bottom being the full width of the keyhole.

* * * * *